US007448494B2

(12) United States Patent
LaSalle

(10) Patent No.: US 7,448,494 B2
(45) Date of Patent: Nov. 11, 2008

(54) LOOSE FILL INSULATION PACKAGED WITH ADDITIVE

(75) Inventor: Michael E. LaSalle, Collegeville, PA (US)

(73) Assignee: Certain Teed Corporation, Valley Forge, PA (US)

( * ) Notice: Subject to any disclaimer, the term of this patent is extended or adjusted under 35 U.S.C. 154(b) by 409 days.

(21) Appl. No.: 11/201,639

(22) Filed: Aug. 10, 2005

(65) Prior Publication Data

US 2007/0036961 A1 Feb. 15, 2007

(51) Int. Cl.
*C10G 19/00* (2006.01)

(52) U.S. Cl. ..... 206/321; 428/313.3; 428/313.5

(58) Field of Classification Search ..... 428/313.5, 428/313.3, 320.2, 321.1, 321.5, 35.2, 35.7, 428/35.9, 297.4, 905; 442/79, 84, 110; 206/321, 206/497, 442, 597
See application file for complete search history.

(56) References Cited

U.S. PATENT DOCUMENTS 3,087,606 A * 4/1963 Vokaty et al. ..... 206/219
3,493,460 A * 2/1970 Windecker ..... 442/222
3,577,515 A 5/1971 Vandegaer
3,816,169 A * 6/1974 Vassiliades et al. ..... 428/313.5
3,846,404 A 11/1974 Nichols
3,900,671 A * 8/1975 Evans ..... 503/207
3,909,444 A * 9/1975 Anderson et al. ..... 428/402.24
3,936,573 A 2/1976 Brockett
3,954,963 A 5/1976 Kuderna, Jr.
4,067,824 A 1/1978 Teng et al.
4,201,822 A * 5/1980 Cowsar ..... 442/64
4,555,447 A * 11/1985 Sieloff et al. ..... 428/392
4,690,825 A * 9/1987 Won ..... 424/501
4,882,220 A * 11/1989 Ono et al. ..... 442/96
5,277,955 A * 1/1994 Schelhorn et al. ..... 428/74
5,336,801 A * 8/1994 Krespan et al. ..... 560/227
5,352,509 A * 10/1994 Talling ..... 442/327
5,683,810 A 11/1997 Babbitt et al.
5,804,297 A * 9/1998 Colvin et al. ..... 428/327
6,060,152 A * 5/2000 Murchie ..... 428/313.5
6,082,639 A 7/2000 Pentz et al.
6,090,478 A * 7/2000 Nishizaki et al. ..... 428/297.4
6,206,050 B1 3/2001 Kelley et al.

(Continued)

FOREIGN PATENT DOCUMENTS

DE 200 06 428 U1 10/2000
WO PCT/EP2006/065225 11/2006

OTHER PUBLICATIONS

Modern Plastics Encyclopedia Volume, vol. 62, No. 10A (for 1985-1986) at pp. 38-87, published by McGraw-Hill, New York, N.Y. (Oct. 1985).

*Primary Examiner*—N Edwards
(74) *Attorney, Agent, or Firm*—Duane Morris LLP; Steven E. Koffs

(57) ABSTRACT

A quantity of glass or mineral fiber, or cellulose insulation is provided. At least one capsule containing a quantity of an additive is provided, such that a there is a predetermined ratio between the quantity of the additive and the quantity of the glass or mineral fiber, or cellulose insulation. The glass or mineral fiber, or cellulose insulation and the at least one capsule are enclosed in a common package.

20 Claims, 5 Drawing Sheets

U.S. PATENT DOCUMENTS 6,244,265 B1 6/2001 Cronk et al.
6,648,022 B2 11/2003 Pentz et al.
6,732,960 B2 5/2004 Shaw et al.
6,901,711 B2 * 6/2005 Fay et al. ..... 52/407.3
7,196,022 B2 * 3/2007 Koenig et al. ..... 442/123
2001/0010235 A1 8/2001 Kelley et al.
2003/0057142 A1 3/2003 Pentz et al.
2005/0281979 A1 12/2005 Toas et al.

* cited by examiner

LOOSE FILL INSULATION PACKAGED WITH ADDITIVE

FIELD OF THE INVENTION

The present invention relates generally to building insulation products, and more specifically to loose-fill insulation products, and methods for manufacturing and installing loose-fill insulation products.

BACKGROUND

The use of fiber glass blowing wool or loose-fill insulation is well known and is preferred by many contractors because it can be easily and quickly applied to new and old buildings and is a relatively low cost material. Loose-fill insulation is produced by forming a non-bindered fiber glass mat and grinding the mat up. After applying additives, the fibers are compressed, and packaged into bags. The insulation is installed by adding the loose-fill to the hopper of a pneumatic blower which blows the loose fill insulation into the desired area. The loose fill insulation can be pneumatically applied over large horizontal surfaces, as well as in cavities to which complete access is not available.

Installers of loose-fill insulation have experienced problems in the field due to product aging, collection of static electric charge, and dust. For example, the static electricity problem has been well documented. Often, the distribution of the blowing wool through the application nozzle and air creates a static charge on the fiber surfaces. The static charge is generated during dry or windy weather conditions as the fiberglass material moves through the blowing machine and the hose. These electric charges repel each other causing small fiber particles to spread out causing a "cloud of dust". Also, static charge causes the fiberglass insulation to stick to the interior surfaces of the attic and the installer, contributes to fiber fly, and can cause a reduction in expected coverage for a given quantity of glass fiber.

In some systems, a hydrophobic agent, such as silicone, was applied to the fiber by spray guns below the spinner, providing uniform coverage. Then the fiber was ground and an antistat was injected onto the fibers. The treated fiber glass material was then ready to be packaged and stored.

Another approach has been to manually add water (alone, or in combination with another liquid such as vegetable oil or anti-freeze) to the hopper by means of a cup or spray bottle. This approach reduces static, but it requires manual intervention by the installer, and may reduce productivity. Also, if excessive water is added, this may reduce the coverage provided by a given quantity (by weight) of insulation.

U.S. Pat. No. 4,555,447, which is incorporated by reference herein, discloses the use of an antistatic agent in the production of blowing wool insulation. The antistat is a quaternary ammonium salt which is applied from an aqueous solution. The antistat reduces the tendency of the small fiber particles to dispense during pneumatic application. When a quaternary ammonium salt antistatic agent was used on the wool, the dust reduction properties were still present six weeks later.

U.S. Pat. No. 5,683,810 further teaches that fabrication of loose-fill insulation product may include the step of applying a dust suppressant or anti-static agent to the surface of the irregularly-shaped fibers before or after the fibers have been cut, milled or chopped.

U.S. Pat. No. 6,732,960, which is incorporated by reference herein, teaches a system for blowing loose-fill insulation, including a loose-fill blowing machine and a discharge hose. An ionizer is disposed in the flow path of the insulation through the discharge hose. The level of static charge is measured or sensed, and the ionizer reduces the static charge developed on the insulation prior to discharge. The insulation is ionized in the flow path of the insulation while the insulation is being discharged to reduce the static charge.

In many cases, the packaged insulation, with the additives applied thereto, was stored more than 90 days after the application of the additives. Additives such as silicone and antistat were not as effective at the end of such a long storage period. As a result, when insulation was kept in storage for periods of 90 days or more, the coverage provided by a package of insulation was less than the coverage provided by the same quantity of insulation if used immediately after manufacture.

An improved method is desired for addressing the static problem in dispensing loose fill insulation.

SUMMARY OF THE INVENTION

In some embodiments, a packaged product comprises a quantity of glass or mineral fiber, or cellulose insulation, at least one capsule containing a quantity of an additive, such that there is a predetermined ratio between the quantity of the additive and the quantity of the glass or mineral fiber or cellulose insulation, and a common package containing the glass or mineral fiber, or cellulose insulation and the at least one capsule.

In some embodiments, a method is provided for using a packaged product comprising a quantity of glass or mineral fiber, or cellulose insulation, at least one capsule containing a quantity of an additive, and a common package containing the glass or mineral fiber, or cellulose insulation and the at least one capsule. There is a predetermined ratio between the quantity of the additive and the quantity of the glass or mineral fiber, or cellulose insulation. The quantity of glass or mineral fiber, or cellulose insulation and the at least one capsule are removed from the common package. The quantity of glass or mineral fiber, or cellulose insulation and the at least one capsule are ground together at an installation site, so as to open the at least one capsule and distribute the additive among the glass or mineral fiber, or cellulose insulation. The glass or mineral fiber, or cellulose insulation is dispensed into a cavity at the installation site.

In some embodiments, a method comprises the steps of: providing a quantity of glass or mineral fiber, or cellulose insulation; providing at least one capsule containing a quantity of an additive, such that a there is a predetermined ratio between the quantity of the additive and the quantity of the glass or mineral fiber, or cellulose insulation; and enclosing the glass or mineral fiber, or cellulose insulation and the at least one capsule in a common package.

DETAILED DESCRIPTION

Figure 1:
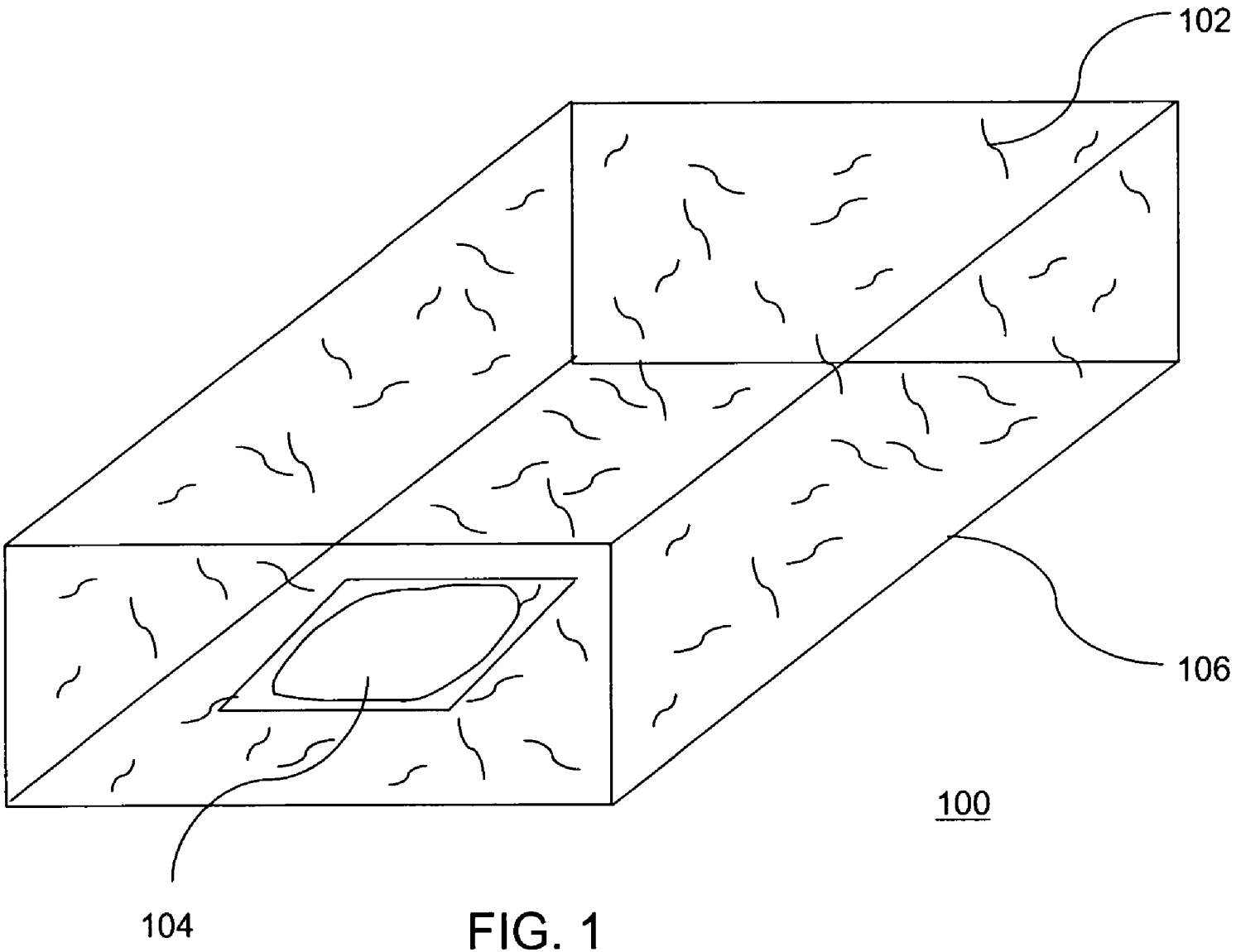
FIG. 1 shows a packaged product according to an exemplary embodiment of the invention.

This description of the exemplary embodiments is intended to be read in connection with the accompanying drawings, which are to be considered part of the entire written description. In the description, relative terms such as "lower," "upper," "horizontal," "vertical,", "above," "below," "up,"

"down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation.

FIG. 1 is a diagram of a packaged product 100 comprising: a quantity (measured by weight) of glass or mineral fiber, or cellulose insulation 102, at least one capsule 104 containing a quantity of an additive, and a common package 106 containing the glass or mineral fiber, or cellulose insulation 102 and the at least one capsule 104. There is a predetermined ratio between the quantity of the additive and the quantity of the glass or mineral fiber, or cellulose insulation 102, approximately equal to the desired ratio of additive to insulation for a product in which the same additive is uniformly blended into the insulation. This ratio varies with the type of additive used and the type of insulation used.

The loose fill insulation 102 may be loose fill fiber glass or cellulose insulation. Other types of fiber insulation that may be used include refractory fibers or mineral wool materials. The insulation may include chopped or cut fibers, loose tufts of fibers, or other small fiber configurations, such as the irregularly shaped three-dimensional shaped fibers described in U.S. Pat. No. 5,683,810, which is incorporated by reference herein.

As used herein, the term "capsule" covers a variety of relatively small cases or containers. The term "capsule" is not limited to conventional cylindrical shapes, but may be spherical, ellipsoidal, pillow-shaped, approximately rectangular, or another shape, and may also include sealed bags or sealed packets, as shown in FIG. 1. In some embodiments, the capsule may have a soft, compliant wall material that does not rigidly maintain a fixed shape.

The carrier (i.e., capsule walls) may be made of a variety of materials, including hydrophilic and hydrophobic materials, and including pressure-release and time-release materials, porous carriers, such as cellulose or hydrophilic porous organic or inorganic particles, or a variety of polymers. The selection of the carrier vehicle for the capsules depends on the type of additive and the installation method. For example, if the contents of the package 106 are to be chopped or ground up, then a pressure release capsule may be used. In some embodiments, time-release capsule wall materials are used, such as any of the materials described in U.S. Pat. No. 4,690,825, which is incorporated by reference herein as though set forth in its entirety. Time-release materials may include semi-permeable or porous materials, such as cellulose or hydrophilic porous organic or inorganic particles.

Preferably, if time-release capsules or microcapsules are used, the package contains an effective amount of water in liquid and/or vapor form to dissolve a sufficient amount of the hydrophilic wall material to release the additive over a period of several weeks, so that the shelf life of the product can be extended significantly beyond the shelf life achieved by spraying the additive on to the insulation prior to packaging. For example, if the capsules or microcapsules are released over a period of about six weeks or more, then the shelf life of a product with antistat capsules can be doubled relative to that described in U.S. Pat. No. 4,555,447. One of ordinary skill can readily determine a capsule wall material and thickness, and a corresponding amount of moisture for the volume contained in a given package, in order to achieve this result.

In a single-capsule embodiment, such as that shown in FIG. 1, a pressure release capsule wall is advantageous, because it is preferable that the additive be well dispersed during installation, and not allowed to release in a single mass into one small portion of the insulation during storage. A pressure release type capsule 104 stays intact until the installer is ready to install the insulation 102, at which time the additive can be substantially blended with the loose-fill insulation to achieve an approximately uniform concentration.

Figure 2:
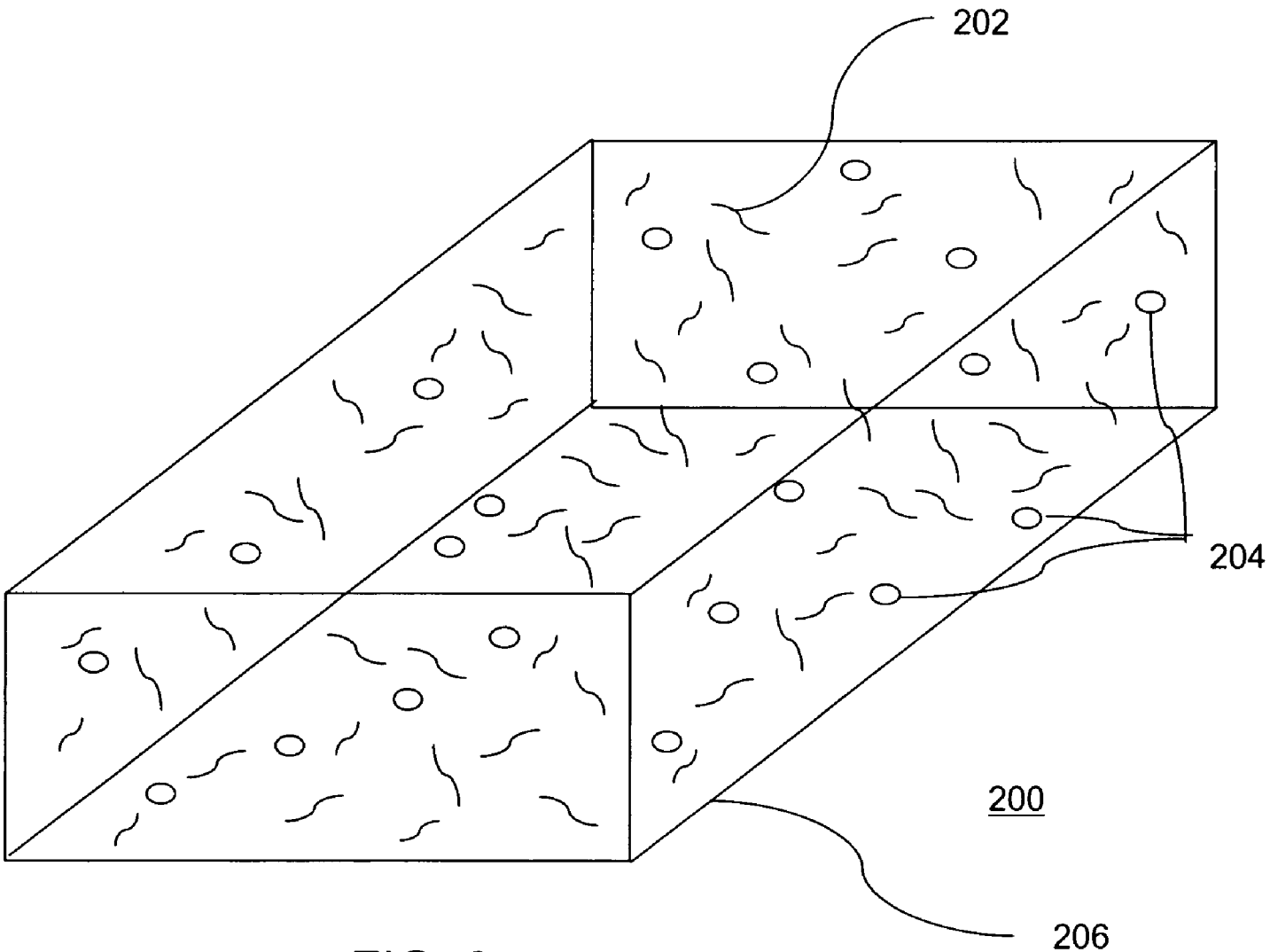
FIG. 2 shows a second packaged product according to an exemplary embodiment of the invention.

The capsule size can vary by orders of magnitude from microcapsules (FIG. 3) to relatively large containers 104 (FIG. 1) capable of storing about four to nine inches$^3$ or about four ounces (about 0.12 liters) of additive or more. Intermediate capsule sizes on the order of about 0.25" to about 0.5" (6 to 12 millimeters), as shown in FIG. 2 may also be used.

The additive may include one or more of an antistat, an oil and/or a hydrophobic agent. Other additives may be used, such as, an agent to improve the coverage of the insulation. An exemplary antistat is a mixture of ethoxylated fatty acid esters, and a quaternary ammonium methane sulfonate. An exemplary ratio of antistat to insulation quantity for this additive and fiber glass loose fill insulation is 0.001 gallons (3.8 centimeters$^3$) to 0.003 gallons (11.4 centimeters$^3$) of antistat per pound of fiber glass. Because it is known that there is parasitic loss of the effectiveness of antistat over time after its release, the amount of antistat per package of insulation may be adjusted based on the length of time that the package can be stored without losing the desired effectiveness. Thus, a package having extra antistat may be sold at a premium based on having a longer shelf life than a less expensive package. The same is true for a package containing oil (dust control), or one containing silicone (water repellency and thus better coverage performance at longer storage times).

The package 106 is preferably formed of a polymer film that is highly resistant to penetration of liquid water and water vapor. Exemplary polymer materials include, but are not limited to polypropylene, polyethylene, polyurethane, polyester, polycarbonate, polyolefin, polyvinyl chloride and ethylene vinyl acetate.

By including in each package of insulation one or more capsules of oil, the dust problem can be reduced or eliminated. By including in each package of insulation one or more capsules of antistat, the static electricity problem can be reduced or eliminated. By including in each package of insulation one or more capsules of a hydrophobic agent (e.g., silicone, wax, a fluorocarbon, or oil), ingress of moisture can be reduced and shelf life (time between manufacture and installation of the insulation) can be extended. The package 100 contains pre-measured amounts of the insulation 102 and the additive 104 in the appropriate pre-determined ratio, to reduce labor (e.g., measurement) and potential errors in the field. The installer can merely empty the entire contents of package 106 into the hopper 401 (FIG. 4) of the insulation blowing machine 400, including the insulation 102 and the capsule 104 containing the additive.

Importantly, in the case of volatile additives, by separately encapsulating the additive, the release of the additive into the insulation can either be postponed by a defined period (in the case of a time-release capsule), or postponed for an indefinite period until ready for installation (in the case of pressure-release capsules). Because the beneficial effects of some additives (e.g., antistat) only last for a limited period (e.g., about six weeks after blending), this method allows the package 100 to be stored for an extended or indefinite period after the package is fabricated.

Although FIG. 1 only shows a single capsule 104, in embodiments where two or more additives are included in the package, each additive may be included in a separate capsule.

Alternatively, if two different additives can be mixed without reacting with each other, then more than one additive may be stored in a single capsule.

FIG. 2 shows another example of a packaged product 200 comprising: a quantity of glass or mineral fiber, or cellulose insulation 202, a plurality of capsules 204 containing a quantity of an additive, and a common package 206 containing the glass or mineral fiber, or cellulose insulation 202 and the plurality of capsules 204. The size of capsules 204 is on the order of about 0.25" to about 0.5" (6 to 12 millimeters), but may be larger or smaller. The plurality of capsules 204 are distributed among the loose fiber insulation 204 within the common package 206. Preferably, the capsules 204 are distributed approximately uniformly among the insulation 204. There is a predetermined ratio between the total quantity of the additive in all the plurality of capsules 204 and the quantity of the glass or mineral fiber, or cellulose insulation 202, equal to the desired ratio of additive to insulation for a product in which the additive is uniformly blended into the insulation.

In some embodiments, the capsules 204 all contain the same type of additive. In other embodiments, the plurality of capsules may contain two or more different types of capsules, containing respectively different additives. The use of capsules 204 instead of a single monolithic additive capsule 104 (FIG. 1) makes it easier to distribute the additive uniformly. Further, if time-release capsules 204 are used, and the additive is partially or completely released before the package 200 is opened, then the additive will already have a relatively even distribution when the package 200 is opened, compared to the package 100 having a unitary, monolithic capsule. Another advantage of smaller capsules 204 over a unitary, monolithic capsule 104 is that the smaller capsules produce less risk of the carrier clogging or jamming the grinder, 404, blower 406 or conduit 408 of the blowing machine 400 (shown in FIG. 4).

Suitable materials for the walls of the capsules of FIG. 2 include, but are not limited to, both gelled capsules and capsules comprising gelatin as a base, either pure (for gelled capsules) or in combination with different substances, glycerine, sorbitol, etc, in the case of soft capsules. Other suitable substances having gelifying characteristics or forming pseudo-colloidal solutions have been tested such as starch, cellulose, and hydrocolloids such as alginate, pectin, xanthane gum, cellulosic by-products such as hydroxypropylmethyl cellulose, and the like.

Cellulose derivatives that may be used include cellulose ether in which some or all of hydroxyl groups thereof are substituted with a lower alkyl group and/or a hydroxyl-lower alkyl group. Examples of the cellulose derivatives include hydroxypropylmethyl cellulose, hydroxyethyl cellulose, hydroxypropyl cellulose, hydroxyethylmethyl cellulose and the like. Examples of gelatinizing agent to be used with the above cellulose derivatives may include carrageenan, polysaccharide of tamarind seed, pectin, curdlan, gelatin, furcellaran, agar, and the like.

Various polysaccharides may be used. Combinations of gellan, xanthan gum and a galactomannan and/or glucomannan gum may be used to produce elastic gels. Blends of low-acetyl gellan gum with xanthan gum and locust bean gum, konjak, tara or cassia gums are useful for modifying the brittleness of gellan food products. A polymer composition comprised of gellan, carrageenan and mannan gums may be used, wherein the mannan gums are selected from a galactomannan or a glucomannan.

Carrageenans may be used in combination with another gelling agent such as mannans, galactomannans, agar, or the like, in fairly low concentrations in the order of 1 to 2%. Examples include Iota, Kappa, Lambda, Mu and Nu carrageenans. More specifically, examples may include polysaccharides, polymers of galactose which are more or less sulfated. Extracts from several different algae may be used: *Chondrus crispus, Gigartina stellata, Gigartina acicularis, Gigartina skottsbergii, Gigartina pistillata, Gigartina chamissoi, Iridea, Eucheuma cottoni, Eucheuma spinosum*. The extracting method implemented leads to different types of carrageenans of which the basic frame is a chain of D-galactoses alternately linked in .alpha.—(1-3) and .beta.—(1-4). The use of the foregoing examples are taught by U.S. Pat. No. 6,331,205, which is incorporated by reference herein in its entirety.

Figure 3:
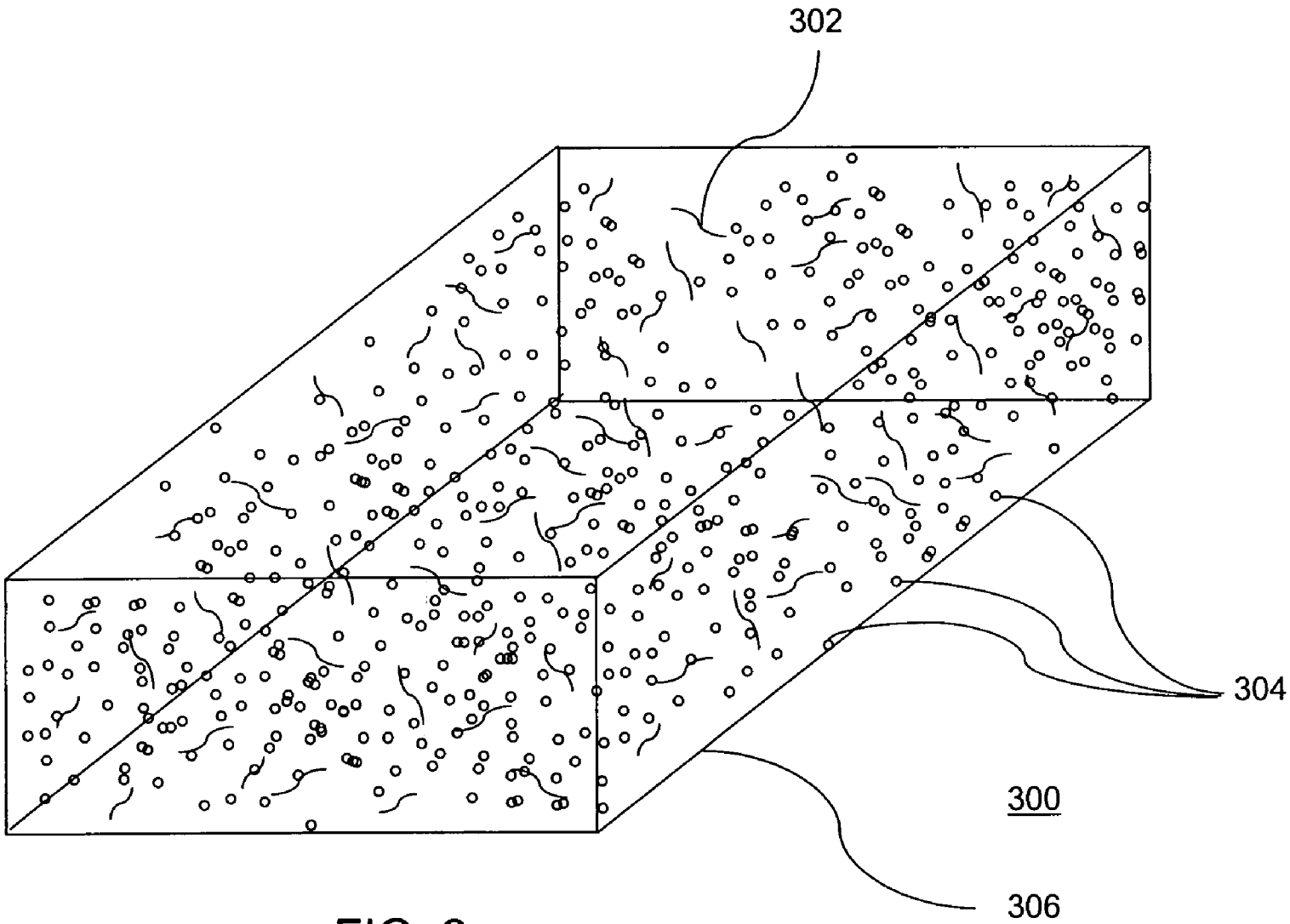
FIG. 3 shows a third packaged product according to an exemplary embodiment of the invention.

FIG. 3 shows another example of a packaged product 300 comprising: a quantity of glass or mineral fiber, or cellulose insulation 302, a plurality of microcapsules 304 containing a quantity of an additive, and a common package 306 containing the glass or mineral fiber, or cellulose insulation 302 and the plurality of microcapsules 304. The plurality of microcapsules 304 are distributed among the loose fiber insulation 302 within the common package 306. Preferably, the microcapsules 304 are distributed approximately uniformly among the insulation 302. There is a predetermined ratio between the total quantity of the additive in all the plurality of microcapsules 304 and the quantity of the glass or mineral fiber, or cellulose insulation 302, equal to the desired ratio of additive to insulation for a product in which the additive is uniformly blended into the insulation. In some embodiments, the microcapsules 304 all contain the same type of additive. In other embodiments, the plurality of microcapsules may include two or more different types of microcapsules, containing respectively different additives. Microcapsules 304 with a hydrophilic, semipermeable, or porous wall are an advantageous carrier if a time-release carrier is desired. Because of their small size, microcapsules 304 can use thinner carrier walls that facilitate time-release, for example by dissolution in the presence of water.

There are several well known types of encapsulation that may be selected to provide a controlled release of the additive. For example, two suitable types of encapsulation include: (a) microcapsules that rupture, by contact pressure, or by partly or completely dissolving in water within the package 106, during storage, so that the additive is released some time after the packaged product 100 is manufactured (b) microcapsules that continually effuse the additive without rupturing, such as porous microcapsules (c) multiphase capsules, such as those disclosed in U.S. Pat. No. 3,909,444 to Anderson et al., which include a water-soluble polymeric active within a liquid permeable, water-insoluble capsule wall, for example, said patent hereby incorporated by reference. As will be understood by those skilled in the encapsulation art, suitable encapsulation technologies include coacervation, prilling, microsponging, and spray drying.

The coating material of the microcapsules can comprise a mixture of waxy materials and polymeric coating materials. These materials may also be used for the walls of larger capsules. For example, some suitable coating materials include both water-insoluble and water-soluble materials, typically selected from waxy materials such as paraffinic waxes, microcrystalline waxes, animal waxes, vegetable waxes, saturated fatty acids and fatty alcohols having from 12 to 40 carbon atoms in their alkyl chain, and fatty esters such as fatty acid triglycerides, fatty acid esters of sorbitan and fatty acid esters of fatty alcohols, or from both water-insoluble and water soluble polymers. Typical specific suitable waxy coating materials include lauric, myristic, palmitic, stearic, arachidic and behenic acids, stearyl and behenyl alcohol, microcrystalline wax, beeswax, spermaceti wax, candelilla wax, sorbitan tristearate, sorbitan tetralaurate, tripalmitin, trimyristin and octacosane. Another exemplary waxy material is coconut fatty acid.

Examples of polymeric materials which can be used for the coating of the microcapsules, herein are cellulose ethers, such as ethyl, propyl or butyl cellulose; cellulose esters such as cellulose acetate, propionate, butyrate or acetatebutyrate; ethylene-vinyl acetate copolymer; polyalkylene glycol such as ethylene, propylene, tetramethylene glycol; urea-formaldehyde resins, polyvinyl alcohol, polyvinyl chloride, polyvinylidene chloride, polyethylene, styrene, polypropylene, polyacrylates, polymethacrylates, polymethylmethacrylates and nylon. Such materials and their equivalents are described in greater detail in any conventional handbook of synthetic organic plastics, for example, in Modern Plastics Encyclopaedia volume, Vol. 62, No. 10A (for 1985-1986) at pages 768-787, published by McGraw-Hill, New York, N.Y. (October 1985), incorporated herein by reference. Another exemplary polymeric material is ethyl cellulose. The polymeric coating materials can be plasticized with plasticizing agents such as phthalate, adipate and sebacate esters, polyols (e.g., ethylene glycol), tricresyl phosphate, castor oil and camphor. These polymeric coatings provide superior protection.

Figure 4:
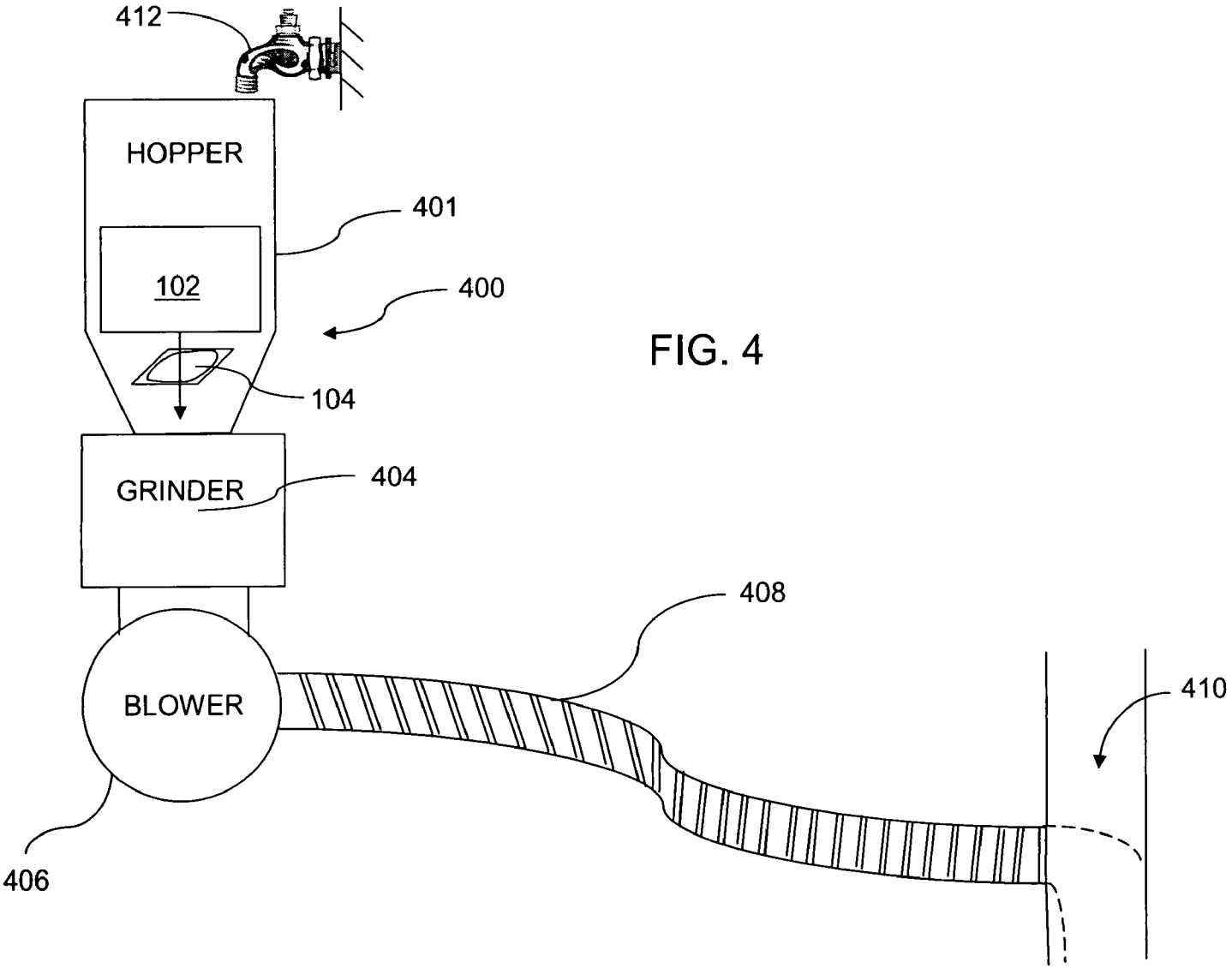
FIG. 4 shows an apparatus for dispensing the insulation product shown in FIGS. 1-3.

FIG. 4 shows a blowing machine 400, which may be of a conventional type or of a future-developed type, that performs the functions of grinding or breaking up insulation and blowing the insulation through a conduit to dispense the insulation.

In blowing machine 400, a hopper is provided for feeding the insulation 102 and the capsule(s) 104 containing one or more additives into the system. In some embodiments, the wall of capsule 104 is cut manually, and the additive poured into the hopper without the carrier (so as to avoid clogging the conduit with an integral, monolithic, relatively tough carrier that resists dissolution and is not easily shredded). In other embodiments (particularly embodiments having capsules 204 or microcapsules 304, the entire contents of the package 200 or 300 are emptied into the hopper, and it is not necessary to remove or filter out the carriers of capsules 204 or 304.

The blowing machine 400 has a grinder 404 that is capable of cutting or breaking apart a large mass of loose fill insulation 102. For a pressure-release capsule 104, the carrier material of the capsule is selected so that the grinding action of the grinder 404 also ruptures the carrier walls of the capsule. For a time-release capsule 204 or microcapsule 304, the carrier material and thickness are selected so that the grinding action of the grinder 404 is sufficient to rupture any undissolved capsules (or microcapsules), from which the additive has not yet been released at the time of installation.

The blower 406 may be of any conventional or future developed type, for impelling the loose-fill insulation 102 through the conduit 408 into the cavity 410.

The conduit 408 may be any type suitable for dispensing loose-fill insulation, such as that described in U.S. Pat. Nos. 6,206,050; 6,648,022; 6,082,639 or U.S. Patent Application Publication Nos. 2001/0010235 or 2003/0057142, the disclosures of said patents and patent applications being incorporated by reference herein in their entireties.

In some embodiments, a water source 412 may optionally be provided to add water to the insulation 202, 302 and capsules 204, 304 in the hopper 401. For example, in some embodiments, the capsules have a time-release carrier, where water within the package 200, 300 is used to release the additive over a predetermined period, (e.g., six weeks). If the installer wishes to use the product before the expiration of the predetermined period (i.e., before release of the additive is completed), then water may be added (e.g., by spray nozzle) to the hopper 401 to accelerate the dissolution of the carriers of the capsules, and facilitate rupturing of the capsule walls in the grinder 404. For the reasons described above with respect to the use of water in the prior art, it is desirable to minimize the amount of water added to the insulation. Therefore, if any water is to be added to the hopper 401 for the purpose of facilitating the release of additives from the capsules, the amount of water may be reduced based on the length of time since the insulation was packaged. The water source 412 is shown symbolically in FIG. 4 as a faucet, but it is understood that any water supply pipe, conduit or hose may provide the water to the nozzle if water is to be added.

Figure 5:
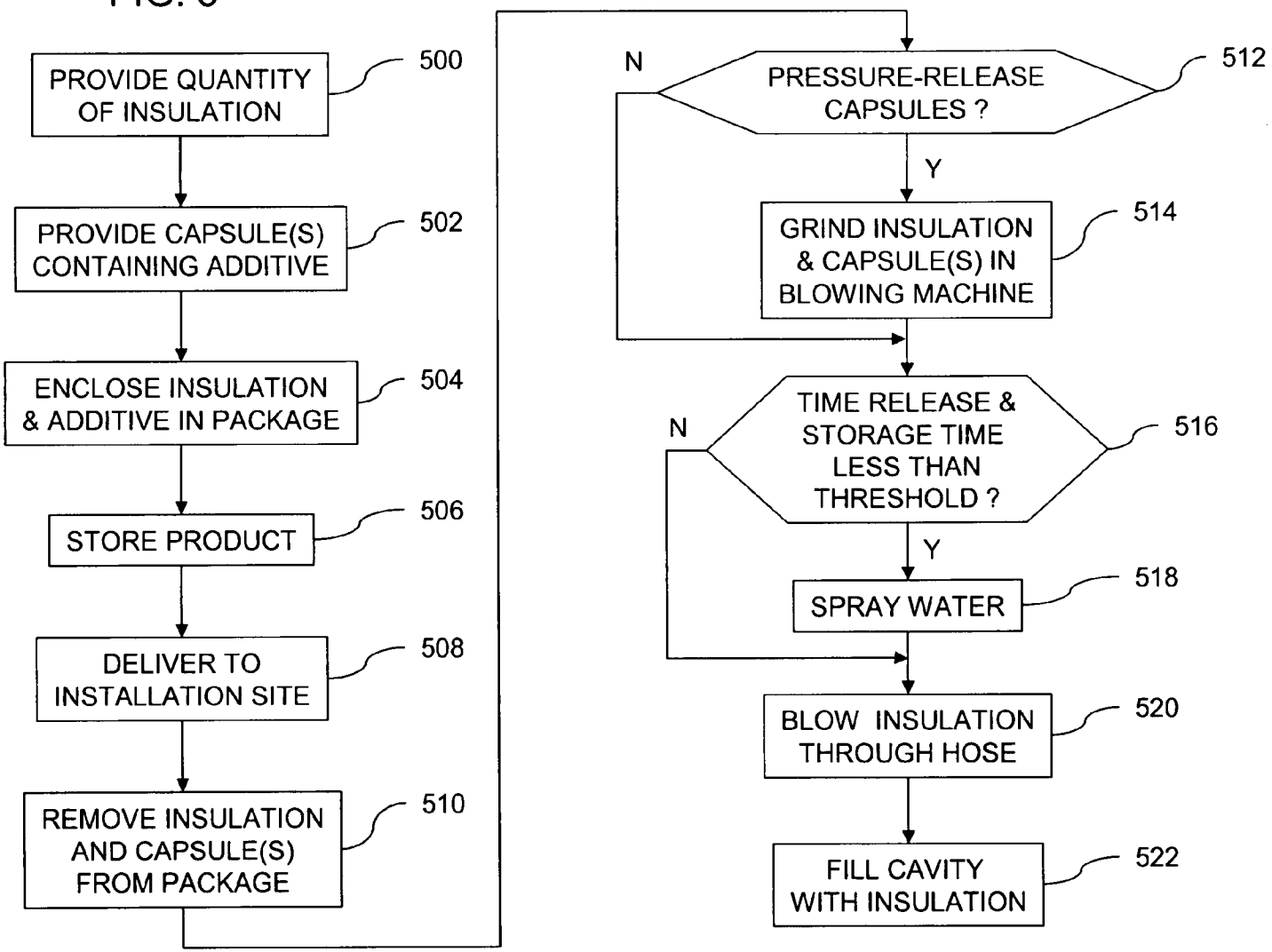
FIG. 5 is a flow chart diagram of a method for fabricating, storing and dispensing the product of FIGS. 1-3.

FIG. 5 is a flow chart diagram of a method for fabricating, storing and using the packaged insulation products of FIGS. 1-3.

At step 500, a quantity of insulation, such as loose-fill fiber glass, is provided. Any quantity may be used. For example, the quantity may be the same as for a conventional loose-fill insulation package that is intended to cover about 56 square feet of attic space to a depth of 6 to 10 inches.

At step 502, at least one capsule containing a quantity of an additive is added, such that a there is a predetermined ratio between the quantity of the additive and the quantity of the glass or mineral fiber, or cellulose insulation. If a plurality of small capsules 204 or microcapsules 304 are used, then it is desirable to distribute the capsules 204 or microcapsules 304 throughout the insulation 202, 302. Preferably, the capsules are mixed in after the fibers have been cooled and cut. In some embodiments the fibers are cut and cooled after emerging from the fiberizer. The capsules are added after the final cooling step and the final cutting step are completed, so that the capsules are not subjected to any heating process or cutting or chopping process that could rupture or damage the capsules. Preferably, the mixing is done online after the final cutting and cooling steps.

For example, in some embodiments, the conveyor leaving the cutting station may feed the insulation material and the capsules into a material blender (not shown) where they are mixed together. The mixed material in the blender can then be fed into packages. In other embodiments, the insulation material and the capsules are fed concurrently into the package 100 from separate source feeds, so that the distribution of the capsules among the insulation material occurs in the package without a separate blending step. It will be understood by those of ordinary skill that more uniform distribution is achieved if a blending step is added before feeding the insulation into the packages, at the expense of providing and maintaining a material blender.

At step 504, the glass or mineral fiber, or cellulose insulation 102, 202, 302 and the at least one capsule 104, 204, 304 are enclosed in a common package 106, 206, 306. If the insulation and capsules have already been mixed in a material blender, then the combination is fed into the package. If the insulation and the capsules have not been previously mixed, then they are fed into the package concurrently.

In some embodiments, such as those including pressure-release capsules, the insulation material and capsules are kept dry before the package 106, 206, 306 is sealed, and no extra water is introduced. Part of the air may be drawn out of the package to reduce volume and moisture content of the package, and the polymer material of the package 106, 206, 306 is heat sealed.

In other embodiments, such as those including time-release capsules with a carrier that is dissolved over time by exposure to moisture, a small amount of moisture can be introduced into the package before sealing, so that the additives are released by the end of a predetermined storage window.

At step 506, the product is stored. If the product 100, 200, 300 includes capsules having a time-release carrier wall, then it is desirable to store the product for a limited period of time (and a date when the product was packaged may be provided on the outside of the package). If the product includes capsules having a pressure-release carrier wall, then the packages 100, 200, 300 can be stored for an extended period of time.

At step 508, the packaged product 100, 200, 300 is delivered to an installation site, perhaps by way of a distributor and/or retailer.

At step 510, the contents, including the quantity of glass or mineral fiber, or cellulose insulation 102, 202, 302 and the at least one capsule 104, 204, 304, are removed from the common package 106, 206, 306.

At step 512, if the capsules are pressure-release capsules, then step 514 is executed. If the capsules are not pressure-release capsules, then step 516 is executed.

At step 514, the insulation 102, 202, 302 and the capsules 104, 204, 304 are broken up or ground up in the blowing machine 400 at the installation site, so as to open the at least one capsule and distribute the additive among the mineral fiber or cellulose insulation.

At step 516, if the capsules are time-release capsules, and the storage time has been less than the threshold time for the capsules to dissolve or release the additive in the package 200, 300, then step 518 is executed. If the storage time has exceeded the threshold, or if capsules are not time-release capsules, the step 520 is executed.

At step 518, water is sprayed into the hopper, to accelerate release of the additive from the capsules or microcapsules onto the insulation.

At step 520, the insulation is blown through the conduit or hose 408, dispensing the mineral fiber or cellulose insulation into a cavity 410 in an attic or wall.

At step 522, the cavity in the wall or attic is filled with the treated loose-fill insulation.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A packaged product, comprising:

a quantity of loose fiber insulation from the group consisting of fiber glass, mineral fiber, or cellulose;

at least one capsule containing a quantity of an additive, the additive being of a type for blending with the loose insulation before or during installation of the loose insulation; and a sealed common package in which the loose insulation and the at least one capsule are contained.

2. The product of claim 1, wherein the additive includes at least one of the group consisting of an antistat, oil and a hydrophobic agent.

3. The product of claim 1, wherein the at least one capsule is a single capsule.

4. The product of claim 1, wherein the at least one capsule includes a plurality of capsules distributed among the loose fiber insulation within the common package.

5. The product of claim 4, wherein the plurality of capsules are pressure release capsules microcapsules.

6. The product of claim 4, wherein the plurality of capsules are time-release microcapsules.

7. The product of claim 6, wherein the time-release microcapsules comprise a hydrophilic wall material.

8. The product of claim 6, wherein the time-release microcapsules comprise a semipermeable or porous wall material.

9. The product of claim 1, wherein:

the fiber insulation is loose fiber glass insulation;

the at least one capsule includes a plurality of pressure release capsules or microcapsules distributed among the loose fiber insulation within the common package, at least some of the capsules or microcapsules containing an antistat, at least some of the capsules or microcapsules containing oil, and at least some of the capsules or microcapsules containing a hydrophobic agent.

10. A method of using the product of claim 1, comprising:.

removing the quantity of glass or mineral fiber, or cellulose insulation and the at least one capsule from the common package;

grinding the quantity of glass or mineral fiber, or cellulose insulation and the at least one capsule together at an installation site, so as to open the at least one capsule and distribute the additive among the glass or mineral fiber, or cellulose insulation; and dispensing the glass or mineral fiber, or cellulose insulation into a cavity at the installation site.

11. The method of claim 10, wherein the grinding step is performed in an insulation blowing machine.

12. The method of claim 11, wherein the dispensing step is performed using the same insulation blowing machine as is used to perform the grinding step.

13. A method of using the product of claim 4 comprising:

removing the quantity. of glass or mineral fiber, or cellulose insulation and the plurality of capsules from the common package;

dispensing the glass or mineral fiber, or cellulose insulation into a cavity at the installation site.

14. A method of using the product of claim 7, comprising:

removing the quantity of glass or mineral fiber, or cellulose insulation and the plurality of capsules from the common package;

spraying or pouring liquid water on the glass or mineral fiber, or cellulose insulation and the time-release microcapsules to accelerate release of the additive from the microcapsules onto the insulation, if a period of time between packaging and using the insulation is less than a threshold period; and dispensing the glass or mineral fiber, or cellulose insulation into a cavity at the installation site.

15. A packaged product, comprising:

a quantity of loose insulation from the group consisting of fiber glass, mineral fiber, and cellulose;

at least one capsule containing a quantity of at least one additive from the group consisting of:

an antistat capable of reducing static electricity in the loose insulation when blended therein, an oil capable of suppressing dust when blended with the loose insulation, and a hydrophobic agent capable of reducing ingress of moisture when blended with the loose insulation; and a sealed polymer film package in which the loose insulation and the at least one capsule are contained.

16. The packaged product of claim 15, wherein the at least one capsule includes a plurality of time release capsules having an anti-stat therein.

17. The packaged product of claim 15, wherein the polymer film package comprises a material that is resistant to penetration of liquid water and water vapor.

18. The packaged product of claim 15, wherein the polymer film package comprises a material from the group consisting of polypropylene, polyethylene, polyurethane; polyester, polycarbonate, polyolefin, polyvinyl chloride and ethylene vinyl acetate.

19. The packaged product of claim 1, wherein the common package comprises a polymer film that is resistant to penetration of liquid water and water vapor, for containing the insulation and the at least one capsule.

20. The packaged product of claim 6, further comprising moisture within the sealed package, for causing release of the time release microcapsules.

* * * * *